US010850955B2

(12) United States Patent
Sunwoo et al.

(10) Patent No.: US 10,850,955 B2
(45) Date of Patent: Dec. 1, 2020

(54) CONTROLLER FOR HOIST CAPABLE OF MULTI-STAGE SPEED CONTROL AND HOIST INCLUDING THE SAME CONTROLLER

(71) Applicant: DAESAN INOTEC INC., Gongju-si (KR)

(72) Inventors: Young Ku Sunwoo, Asan-si (KR); Sung Woo Woo, Sejong-si (KR)

(73) Assignee: DAESAN INOTEC INC., Gongju-si (KR)

( * ) Notice: Subject to any disclaimer, the term of this patent is extended or adjusted under 35 U.S.C. 154(b) by 0 days.

(21) Appl. No.: 16/578,783

(22) Filed: Sep. 23, 2019

(65) Prior Publication Data

US 2020/0255268 A1 Aug. 13, 2020

(30) Foreign Application Priority Data

Feb. 12, 2019 (KR) ..... 10-2019-0016343

(51) Int. Cl.
*B66D 1/46* (2006.01)

(52) U.S. Cl.
CPC ..... *B66D 1/46* (2013.01); *B66D 2700/025* (2013.01)

(58) Field of Classification Search
CPC ..... B66D 1/46; B66D 3/26
USPC ..... 318/268, 255
See application file for complete search history.

(56) References Cited

U.S. PATENT DOCUMENTS 9,413,279 B2 * 8/2016 Rho ..... H02P 29/685

FOREIGN PATENT DOCUMENTS

| | | | |
|---|---|---|---|
| JP | H07296671 | A | 11/1991 |
| KR | 20090042102 | A | 4/2009 |
| KR | 20180156601 | | 12/2018 |

* cited by examiner

*Primary Examiner* — David Luo
(74) *Attorney, Agent, or Firm* — Dinsmore & Shohl LLP; Yongsok Choi, Esq.

(57) ABSTRACT

Disclosed herein is a controller of a hoist. The controller of a hoist includes a lift up button which is adjustable in a pressed degree; a lift down button which is adjustable in a pressed degree; lift up button contacts configured to allow ascending direction control power to flow to a motor when the lift up button is pressed; lift down button contacts configured to be in contact when the lift down button is pressed and allow descending direction control power to flow to the motor; a magnet accommodated in each of the lift up button and the lift down button; and a Hall sensor disposed to detect a descending degree of the magnet accommodated in each of the lift up button and the lift down button.

2 Claims, 13 Drawing Sheets

ALL OF FOLLOWING FUNCTIONS ARE INTEGRATED

INVERTER
INTEFACE
TRANSFORMER
CT
LOAD LIMITER
RECTIFIER
MAGNETIC CONTACTOR
BLUETOOTH

CONTROL IS POSSIBLE WITH MOBILE DEVICE THROUGH BLUETOOTH COMMUNICATION

CONTROLLER FOR HOIST CAPABLE OF MULTI-STAGE SPEED CONTROL AND HOIST INCLUDING THE SAME CONTROLLER

CROSS-REFERENCE TO RELATED APPLICATION

This application claims priority to and the benefit of Korean Patent Application No. 10-2019-0016343, filed on Feb. 12, 2019, the disclosure of which is incorporated herein by reference in its entirety.

BACKGROUND

1. Field of the Invention

The present invention relates to a controller for a hoist, which is capable of controlling multi-speeds, and a hoist including the same.

2. Discussion of Related Art

Generally, a hoist is a device which is used for transporting a cargo in a warehouse, a railway station, a mold factory, a casting factory, and the like or used for disassembling and assembling machinery in a factory and is a device for lifting a heavy object through an operation of a motor to transfer the heavy object to a desired position.

The hoist includes a motor, a speed reduction gear device, a brake, and the like. A hook is provided at an end of a load chain to lift up a cargo and then move in a transverse direction (left-right direction) to transfer the lifted cargo to a desired position. Typically, the hoist may be broadly classified into an electric hoist, an air hoist, and the like.

The electric hoist is a small traction machine in which a small electric motor, a winding drum with a planetary gear-type speed reducer, an electromagnetic brake which holds a cargo, a load brake which controls a speed when a cargo is lifted down are concentrated on a narrow container space. The electric hoist is attached to an end of a jib or is used for transferring a cargo by lifting up and down the cargo while traveling on a flange below an I-shaped beam through a rail. The electric hoist employs a method of manipulating a rope to move a motor on the ground, a method of moving a button, a remote manipulation method, or the like.

The air hoist is mainly used in a place for preventing a risk of gas explosion, such as a coal mine, a chemical plant, or the like.

Further, in addition to the above-described electric hoist and air hoist, the hoist may be classified into various types of hoists, such as a low head type hoist used at a place in which a ceiling is low, a double rail type hoist traveling on two rails, and the like, according to a use place and a structure of a machine.

The electric hoist among the various types of hoists may be classified into a hoist using a relay switch and a hoist using an inverter. Among these hoists, the hoist using the relay switch cannot be miniaturized because, when a control signal is generated according to lift up and down manipulations of an operator, the control signal is generated using a relay switch. Since a service life of the hoist using the relay switch is relatively short, materials costs and labor costs are largely consumed, and, since a wiring is complicated, there are problems in that it is difficult to manufacture the hoist using the relay switch in a small size and a light weight, a large amount of electric power is consumed, and noise such as electromagnetic waves is severely generated.

In order to solve the above-described problems of the relay type hoist, an electric hoist using an inverter driven motor, which is driven by an inverter embedded in a main body, has appeared.

Unlike the relay type hoist, the electric hoist using an inverter driven motor may generate a signal according to a button operation of an operator through a contactless interface element, transmit the signal to an inverter, and control driving of a motor. Consequently, when compared with the conventional relay type hoist, a service life of the electric hoist using an inverter driven motor can be semi-permanent, a small size and weight reduction of the electric hoist using an inverter driven motor can be achieved, and the electric hoist using an inverter driven motor can be disposed to be close to the inverter to prevent malfunction due to noise. Further, since a wiring of the electric hoist using an inverter driven motor is simple, there are effects in that a production cost can be reduced due to a decrease in materials costs and labor costs, electricity can be saved, after service (A/S) can be facilitated through blocked components, and the inverter can be prevented from an abnormal voltage by completely separating an input and an output. An inverter interface controller of a related art can control a motor (induction motor) in two speeds. For example, the inverter interface controller can rotate the motor at speeds of 1,000 revolutions per minute (RPM) and 1,500 RPM. Only a two-stage speed control switch is implemented in a controller for controlling two-stage speeds. An inverter interface control method of the related art is shown in FIG. 1. As shown in FIG. 1, a controller (a controller of a hoist is called a teaching pendant, and the controller is indicated as a teaching pendant in FIG. 1) can control only three-stage speeds of a neutral, a first-stage speed, and a second-stage speed when a button is in a pressed state. In the predetermined three-stage speeds, an inverter connected to an inverter control terminal block can control a motor to vary a speed in only three states of a neutral state (in which the motor is stopped), a first-stage state (a ½ speed of a rated speed), and a second-stage state (the rated speed).

In order to solve the above-described problems of the related art exhibiting a limitation on a variation in stage of speed control, the applicant of the present invention has researched to complete the present invention which is capable of controlling multi-stage speed in proportion to a degree of pressing a controller and has filed Korean Patent Application Nos. 10-2018-0156574, 10-2018-0156584, and 10-2018-0156601. The above Korean patent applications are different in control method. A digital pulse method is employed In Korean Patent Application No. 10-2018-0156574, a pulse width modulation (PWM) method is employed in Korean Patent Application No. 10-2018-0156584, and a variable resistance method is employed in Korean Patent Application No. 10-2018-0156601.

Inventors of the present invention has studied on a structure of a controller which is simplified and reliable and facilitates multi-stage speed control of a hoist on the basis of a multi-stage speed control feature (including all of the digital pulse method, the PWM method, and the variable resistance method). As a result, the present invention was achieved.

SUMMARY OF THE INVENTION

The present invention is directed to a controller of a hoist, which is capable of performing multi-stage speed control of lifting up and down of an electric hoist using an inverter driven motor.

The present invention is also directed to a hoist including the controller.

A typical configuration of the present invention for achieving the above-described objectives is as follows.

The present disclosure is directed to a controller of a hoist. According to an aspect of the present invention, there is provided a controller of a hoist, which includes a lift up button which is adjustable in a pressed degree; a lift down button which is adjustable in a pressed degree; lift up button contacts configured to be in contact with the lift up button when the lift up button is pressed and allow ascending direction control power to flow to a motor; lift down button contacts configured to be in contact with the lift down button when the lift down button is pressed and allow descending direction control power to flow to the motor; a magnet accommodated in each of the lift up button and the lift down button; and a Hall sensor disposed to detect a descending degree of the magnet accommodated in each of the lift up button and the lift down button. When the lift up button is pressed, the lift up button contacts may be primarily brought into contact such that the ascending direction control power may be applied to the motor, the lift up button may further be pressed in such a state, a pressed degree of the lift up button may be adjustable, a relative distance between the magnet accommodated in the lift up button and a corresponding Hall sensor may be variable, and a speed of an ascending operation of the motor may be varied according to an output voltage which is varied according to an increase or decrease of a magnetic flux density detected by the Hall sensor. When the lift down button is pressed, the lift down button contacts may be primarily brought into contact such that the descending direction control power may be applied to the motor, the lift down button may further be pressed in such a state, a pressed degree of the lift down button may be adjustable, a relative distance between the magnet accommodated in the lift down button and a corresponding Hall sensor may be variable, and a speed of a descending operation of the motor may be varied according to an output voltage which is varied according to the increase or decrease of the magnetic flux density detected by the Hall sensor.

Two lift up button contacts and two lift down button contacts may be provided, and when a conductive contact portion of a horizontal extending shape connected to the lift up button and the lift down button is brought into contact with the two lift up button contacts or the two lift down button contacts, control power may be conducting such that an operation of the motor may be initiated. The two lift up button contacts and the two lift down button contacts, to which the control power of the motor is applied, may be provided to be separated from an electric circuit in which the Hall sensor is provided.

In addition to the above-described configuration, additional configurations may further be included in the controller of the hoist according to the invention or in the hoist including the controller.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which.

DETAILED DESCRIPTION OF EXEMPLARY EMBODIMENTS

Figure 1:
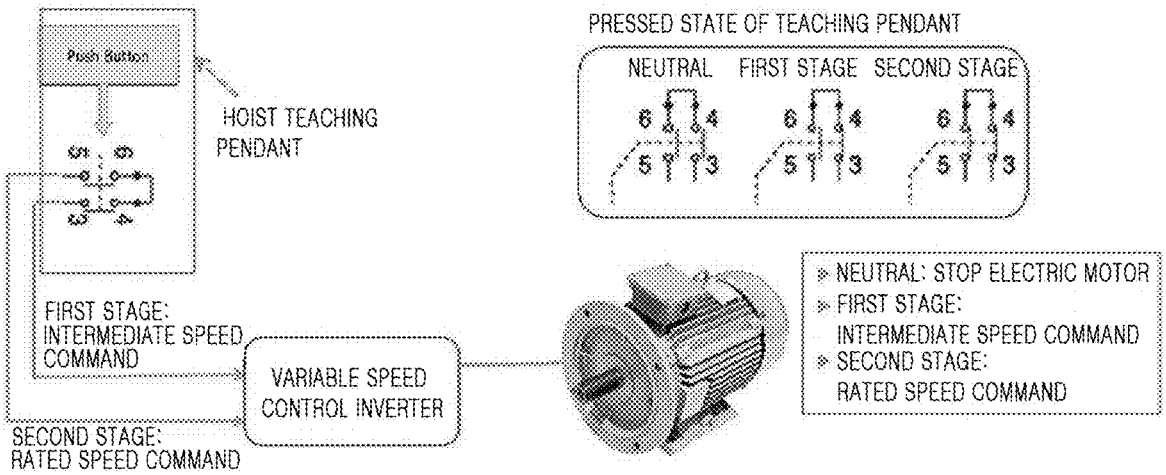
FIG. 1 is a diagram illustrating an inverter interface control method according to a related art.

In the following detailed description, reference is made to the accompanying drawings that illustrates, by way of illustration, specific embodiments in which the present invention may be practiced. These embodiments are fully described in detail to allow those skilled in the art to practice the present invention. It should be understood that various embodiments of the present invention, although different, are not necessarily mutually exclusive. For example, specific forms, structures, and characteristics described herein may be implemented by being altered from one embodiment to another embodiment without departing from the spirit and scope of the present invention. Further, it should be understood that positions or arrangement of individual elements within each embodiment may also be modified without departing from the spirit and scope of the present invention. Accordingly, the following detailed description is not to be taken in a limiting sense, and the scope of the present invention should be construed to include the scope of the appended claims and equivalents thereof. In the drawings, like numerals refer to the same or similar components throughout various aspects.

Hereinafter, exemplary embodiments of the present invention will be described in detail with reference to the accompanying drawings so as to allow those skilled in the art to which the present invention pertains to practice the present invention.

Hereinafter, plural types of inverter-type hoists will be described with reference to FIGS. 2 to 5.

Figure 2:
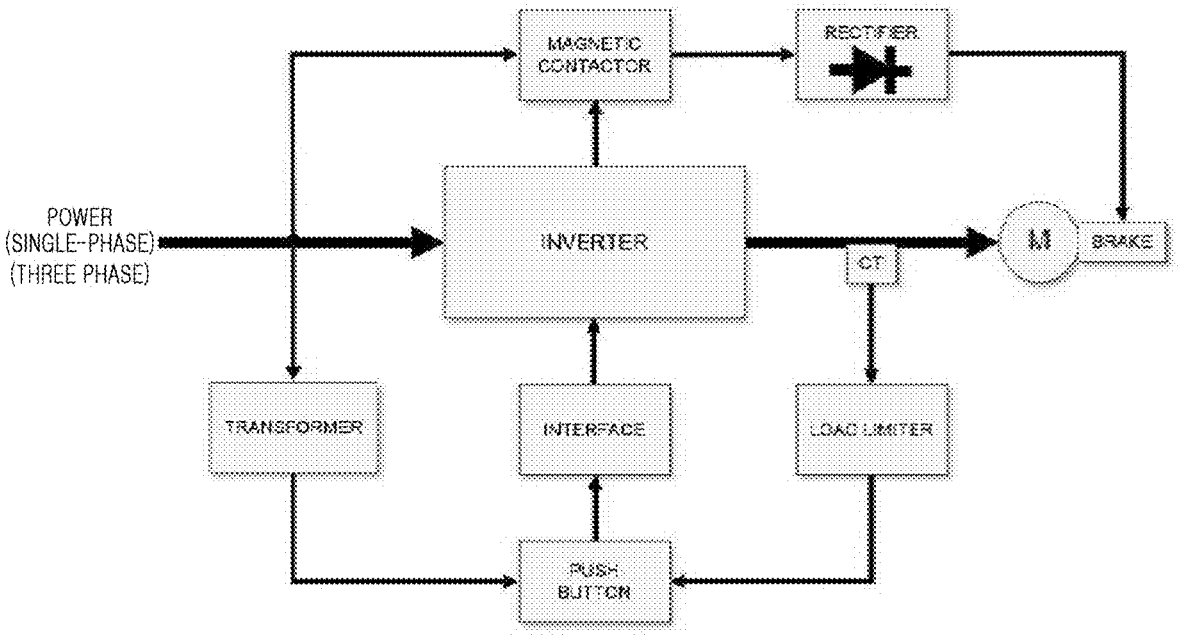
FIG. 2 is a diagram for describing functions of an inverter and peripheral function parts in an inverter-type hoist using a general-purpose inverter.

First, FIG. 2 is a diagram for describing functions of an inverter and peripheral functional parts in an inverter-type hoist using a general-purpose inverter. The inverter is a functional part which controls a motor at a desired speed by varying a voltage and a frequency in a variable voltage variable frequency (VVVF) method. A transformer is a functional part which converts an input voltage to an alternating current (AC) of, e.g., 110V to use the AC of 110V as a control power source. An interface is a functional part serving as a medium (electronic relay) for controlling the inverter at an AC voltage of, e.g., 110V. A push button is a functional part which serves as a push button switch for manipulating the hoist. A functional part indicated as "CT" converts a current ratio. A load limiter is a functional part which receives a variation in current according to a load from the CT to control a lift up operation of the hoist. A magnetic contactor is a functional part which performs a function of supplying a voltage to a rectifier and is controlled by an inverter. The rectifier is a functional part which performs a function of converting an AC voltage into a direct-current (DC) voltage. A brake is a functional part which serves as a solenoid-type motor brake operated by a DC current. The rectifier and the solenoid-type brake are components which are functionally connected. That is, the rectifier converting the AC voltage into the DC voltage is provided because the solenoid-type brake is operated by the DC current. When the solenoid-type brake is not used and a mechanical brake is used, it is not necessary to convert the AC voltage into the DC voltage and thus the rectifier may be omitted from an entirety of a configuration. A functional part indicated as "M" is a three-phase squirrel-cage induction motor and is a functional part which generates a driving force of the hoist. Power is three-phase and single-phase input voltages and is a functional part which performs a function of supplying power to the hoist. It should be understood that the functions of the peripheral functional parts including the inverter in the above-described inverter-type hoist are well known in the art at the time of filing of the present invention and can be clearly understood by those skilled in the art without further description.

Figure 3:
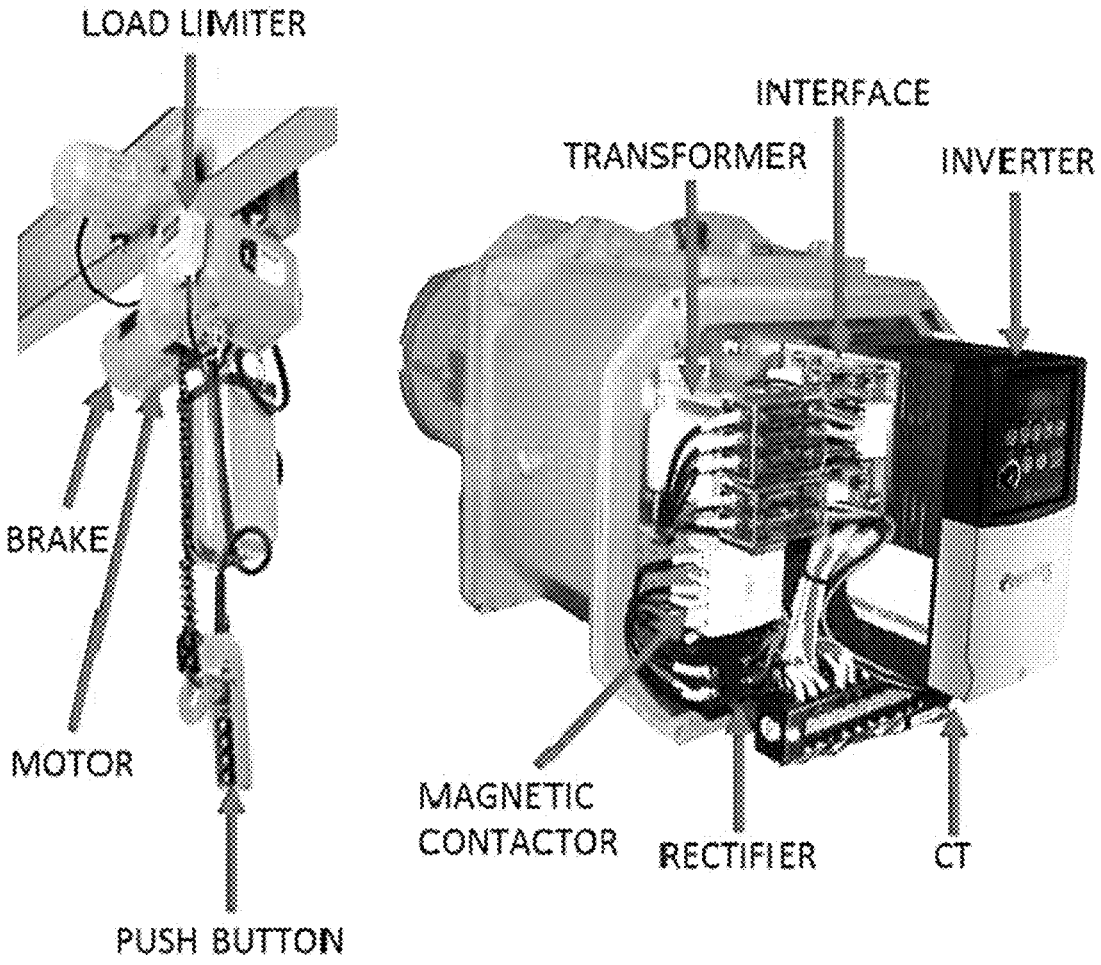
FIG. 3 is a diagram illustrating an appearance of an inverter-type hoist using a general-purpose inverter.

FIG. 3 is a diagram illustrating an appearance of an inverter-type hoist using a general-purpose inverter. Referring to FIG. 3, it can be seen more specifically of an appearance of a hoist in which a general-purpose inverter is used as an inverter functional part.

Figure 4:
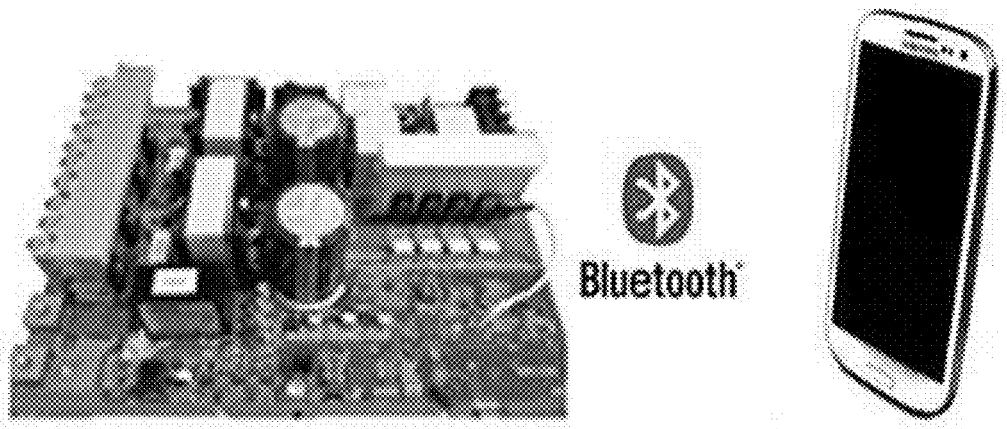
FIG. 4 is a diagram illustrating a concept of a hoist including an inverter integrated board.
Figure 11:
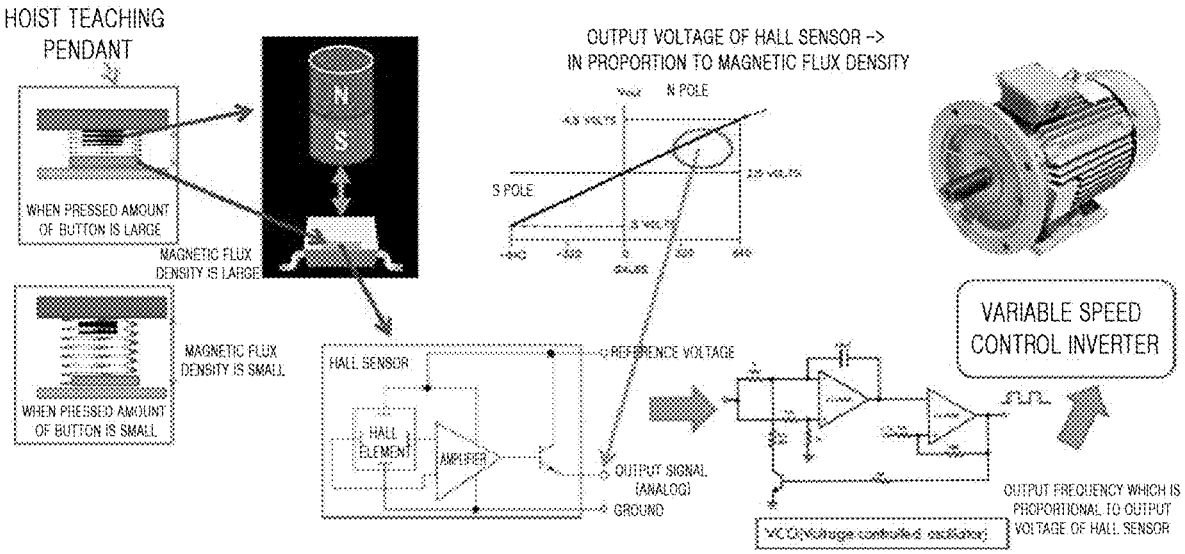
FIG. 11 is a diagram for describing a method of varying a speed of a motor according to a manipulation of the controller according to one embodiment of the present invention.

As compared with the embodiment of FIG. 3, a concept of a hoist including an inverter integrated board according to FIG. 4 should be understood. Referring to FIG. 4, it will be clearly understood that the inverter function part and the peripheral functional parts of the inverter functional part, which are described in FIG. 2, may be integrated into a single board. Specifically, according to an embodiment of FIG. 4, the inverter functional part, the interface functional part, the transformer functional part, the CT functional part, the load limiter functional part, the rectifier functional part, and the magnetic contactor functional part may be integrated into a single board. Further, a radio control functional part may be added. The radio control functional part is indicated as "Bluetooth" in FIG. 4. The radio control functional part may be implemented as a functional part which replaces the function of the push button functional part described in the embodiment of FIG. 2. In the embodiment shown in FIG. 4, it should be definitely understood that, instead of a general-purpose inverter, the inverter functional part for driving the hoist, i.e., a functional part for controlling the motor at a desired speed (e.g., as shown in FIG. 11, a control functional part controls a speed of the motor in a multiple stage) is integrated with the other functional parts into a single board. When compared with FIG. 3, features of the embodiment shown in FIG. 4 can be clearly understood. That is, a wiring between the functional parts is not necessary, and a terminal pressing process and a terminal tightening process may be omitted. Thus, since manual processes are significantly omitted, labor costs may be saved and production time may be shortened. Further, causes of various defects occurring in an assembly process, such as a wiring defect, a terminal pressing defect, a terminal tightening defect, and the like, may be fundamentally removed.

Figure 5:
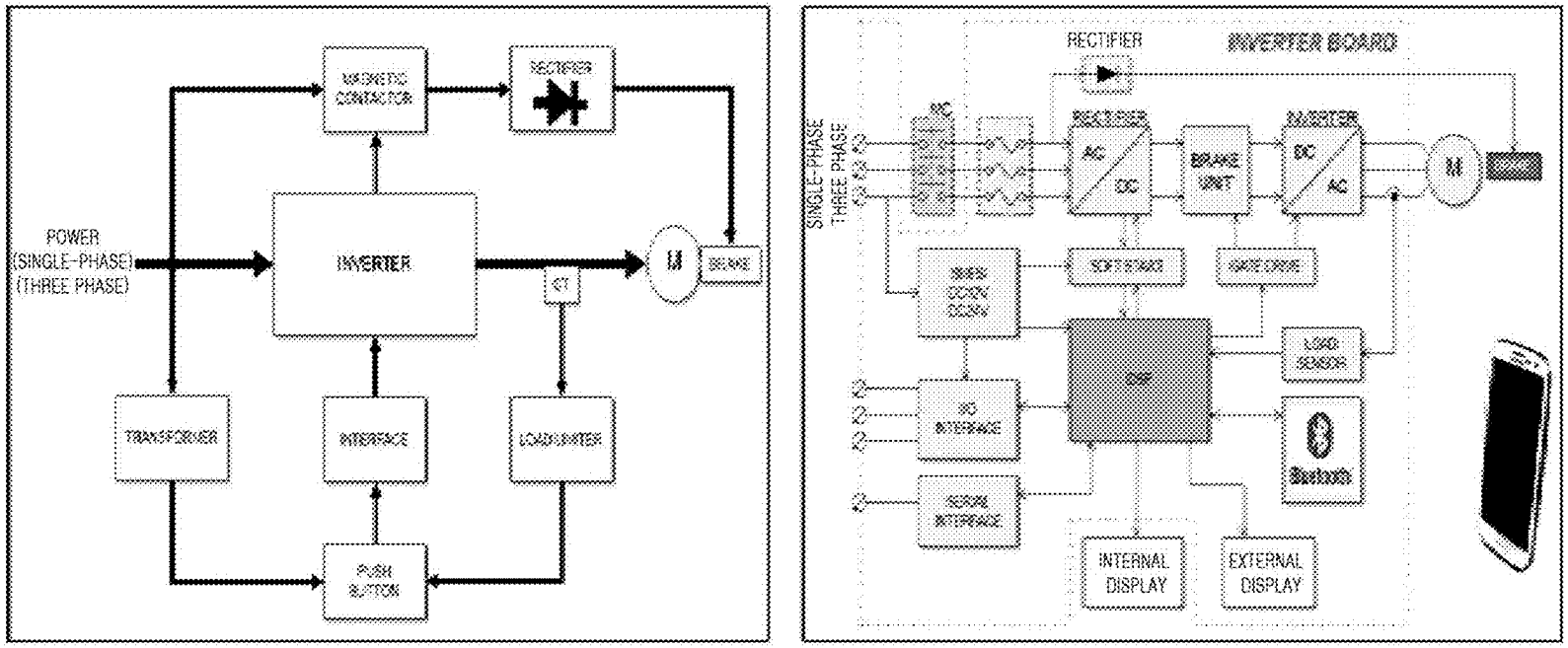
FIG. 5 is a diagram comparing a circuit diagram of an inverter-type hoist using a general-purpose inverter with a circuit diagram of a hoist including an inverter integrated board.

FIG. 5 is a diagram comparing a circuit diagram of an inverter-type hoist using a general-purpose inverter with a circuit diagram of a hoist including an inverter integrated board. Unlike the inverter-type hoist using a general-purpose shown in a left side of FIG. 5, in the hoist including an inverter integrated board, electric functional parts including the inverter functional part for driving the hoist are integrated into a single board. More specifically, the hoist including an inverter integrated board according to the embodiment of FIG. 4 of the present invention is developed such that a weight of an inverter is reduced and supply energy, which is instantaneously applied, is rapidly supplied for a short period of time such that initial driving is efficiently performed. Here, a capacity of each of two examples of integrated inverters, which have AC input voltages in a range of 200 to 240V and in a range of 380 to 460V was tested, and the hoist was developed to have a continuous driving time of 60 minutes or more with 3.7 KW (5 HP) in each of a single-phase and a three-phase. An AC/DC rectifier for the inverter was designed to convert commercial AC power into a motor driving DC voltage of the hoist including the inverter integrated board and developed to be able to supply a stable driving voltage irrespective of a variation characteristic of the inverter. With respect to a three-phase insulated gate bipolar transistor (IGBT) inverter circuit, a circuit composed of an IGBT switching element which controls to allow the motor to be rotated below 2,000 RPM was developed. Further, the hoist including the inverter integrated board may include a plurality of specific dedicated functions. For example, the hoist may include a load limiter function of blocking overload, a function of controlling a wired/wireless remote controller, a function of outputting brake power, a function of counting the number of times of use, a function of controlling Bluetooth communication, and a display function of monitoring an operating state. Functions performed by functional parts shown in FIG. 5 are as follows. First, a digital signal processor (DSP) is an integrated circuit which converts an analog signal into a digital signal to process the digital signal at a high speed. A switching mode power supply (SMPS) is a power supply device which converts AC power into DC power using a switching transistor and the like. A magnetic contactor is a component which performs a function of supplying a voltage to a rectifier. The rectifier is a component which converts an AC voltage into a DC voltage. A soft start is a component which smoothly drives a motor. A break unit is a component which consumes regenerative power of the motor, which is generated by inertia or gravity. An inverter is a component which converts a DC voltage into an AC voltage having a desired frequency and a desired voltage. A gate drive is a component which is turned on by allowing a small current to flow to the DSP to control the inverter and the brake unit. A load sensor is a component which detects a variation in current according to a weight. An input/output (I/O) interface is an input/output connector with an external device. A serial interface is a component which sets or changes the inverter using RS232 or the like as a serial interface. Bluetooth is a wireless interface component which connects to a mobile device and the like in a wireless manner. Internal and external displays show various information such as a use time of the hoist, a current, a voltage, and the like. A brake is a solenoid-type motor brake which is operated by a DC current. A component indicated as "M" is a single-phase or three-phase squirrel cage induction motor, and the "single-phase" and the "three-phase" represent a single-phase input voltage and a three-phase input voltage, respectively.

Figure 6:
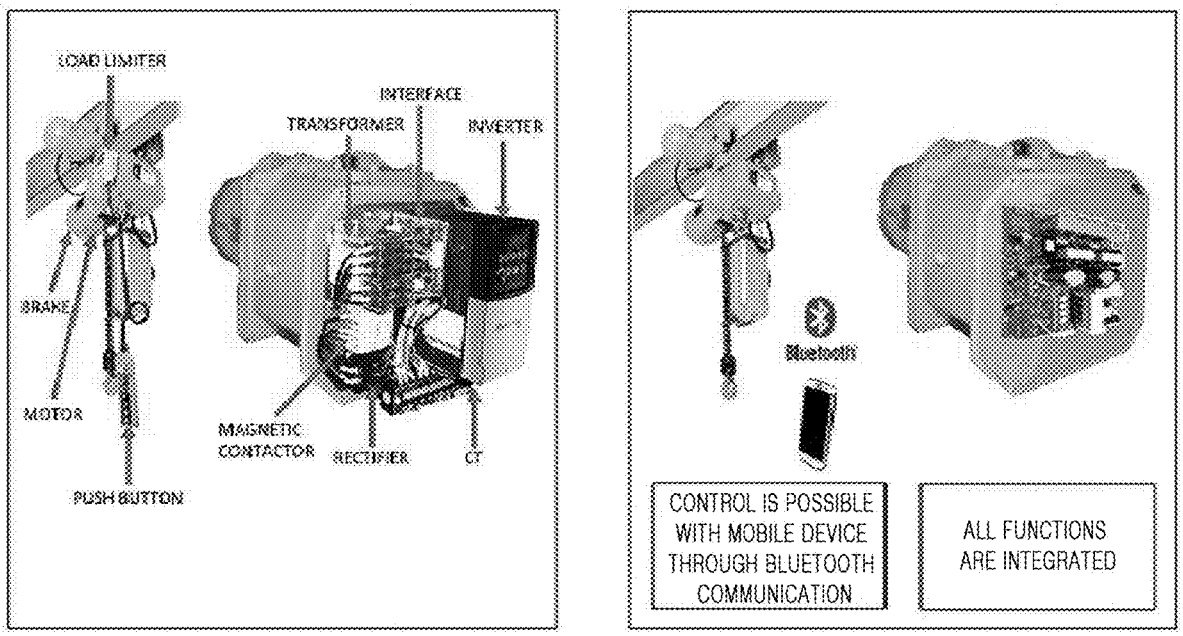
FIG. 6 is a diagram comparing the hoist including the inverter integrated board with the hoist using the general-purpose inverter.

FIG. 6 is a diagram comparing the hoist including the inverter integrated board with the hoist using the general-purpose inverter that clearly concisely illustrates technical features of the two hoists. Referring to FIG. 6, it can be intuitively understood that a feature due to the inverter integrated board, a feature in which the inverter integrated board is connectable to a user terminal in a wireless manner through a wireless connection interface such as Bluetooth, and a feature in which various arithmetic operations required for efficient hoist driving is operable through the user terminal including an arithmetic operation function.

Figure 7:
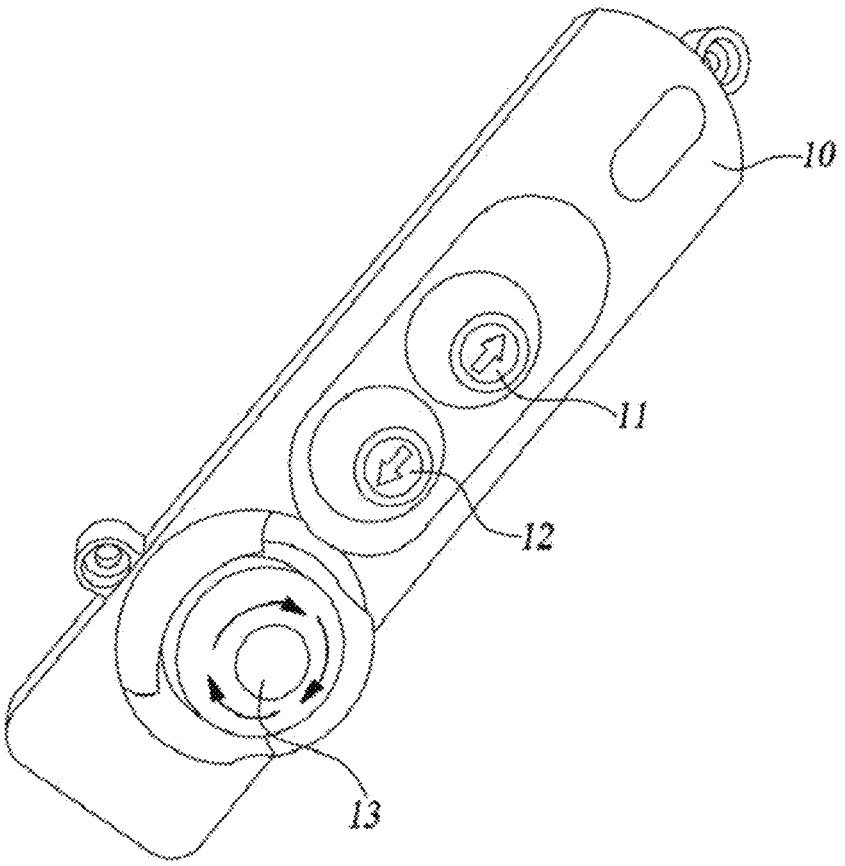
FIG. 7 is a diagram illustrating an appearance of a controller of a hoist, which is capable of control multi-stage speeds, according to one embodiment of the present invention.

FIG. 7 is a diagram illustrating a controller 10 of a hoist which is capable of controlling multi-stage speeds according to one embodiment of the present invention. The controller 10 of the embodiment of FIG. 7 employs a push button among the above-described control methods. Among the above-described control methods, there is present a wireless control method using a connection including Bluetooth without using a push button. The controller 10 of the hoist according to the present invention is limited to a method using a push button except for the wireless control method. Hereinafter, the controller 10 employing a push button will be described. This push-button controller 10 is applicable to both of the hoist including the inverter integrated board and the hoist using the general-purpose inverter, which are described above.

FIG. 7 illustrates an appearance of the push-button controller 10. The controller 10 is illustrated as having three buttons. A lift up button 11, a lift down button 12, and an ON/OFF button 13 of the hoist may be provided on the controller 10.

Figure 8:
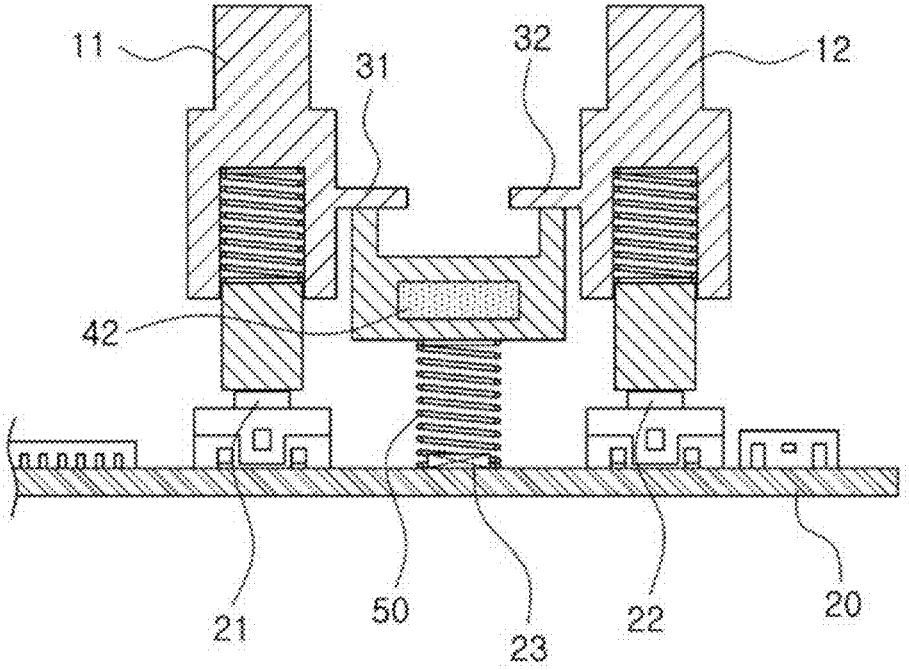
FIG. 8 is a diagram illustrating a switch structure inside the controller of the hoist that shows an embodiment different from the embodiment according to the present invention.

FIG. 8 is a diagram illustrating a switch structure inside the controller of the hoist that shows an embodiment different from the embodiment according to the present invention. An internal structure shown in FIG. 8 is described in the specifications of the three Korean patent applications of the applicant, which are referred in the background of the present invention. In this disclosure of the present invention, the internal structure will be simply described for the purpose of comparison with a switch structure of the controller according to the present invention.

A lift up switch 21, a lift down switch 22, and a Hall sensor 23 are provided on a substrate 20. The Hall sensor 23 is a sensor which, when a magnetic field is applied to a conductor through which a current flows, detects a direction and a magnitude of the magnetic field using a Hall effect in which a voltage is generated in a direction perpendicular to the current and the magnetic field.

A press transfer part, which transfers a press operation of each of switches 21 and 22 to the switch 21 or 22 of the substrate 20, is provided below each of the lift up button 11 and the lift down button 12. The press transfer part corresponding to the lift up button 11 is a lift up button pressing transfer part 31, and the press transfer part corresponding to the lift down button 12 is a lift down button pressing transfer part 32. Functions of the pressing transfer parts 31 and 32 are to transmit the pressing operations of the lift-up button 11 and the lift-down button 12 to a magnet 42. In the internal structure shown in FIG. 8, it can be easily understood that, when the lift up button 11 is pressed, a command for pressing the lift up switch 21 to raise the hoist is generated and, simultaneously, the lift up button pressing transfer part 31 is pressed and thus the magnet 42 is pressed such that the Hall sensor 23 becomes to be relatively close to the magnet 42. Similarly, in the internal structure shown in FIG. 8, it can be easily understood that, when the lift down button 12 is pressed, a command for pressing the lift down switch 21 to lower the hoist is generated and, simultaneously, the lift down button pressing transfer part 32 is pressed and thus the magnet 42 is pressed such that the Hall sensor 23 becomes to be relatively close to the magnet 42. When the pressing of the lift up button 11 or the lift down button 12 is released, the magnet 42 ascends to its original position according to an operation of a spring 50. Consequently, the pressing transfer parts 31 and 32 and the buttons 11 and 12, which are operatively connected to the pressing transfer parts 31 and 32, also return to their original positions.

Figure 9:
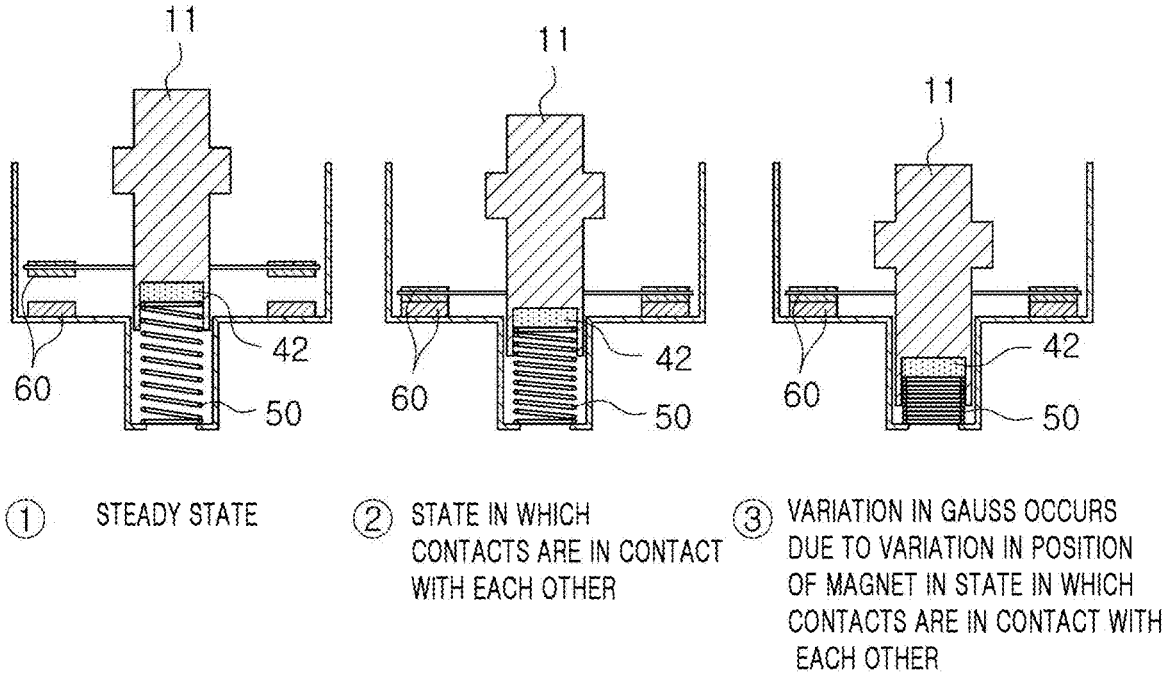
FIG. 9 is a diagram for describing a switch operation method inside the controller of the hoist according to one embodiment of the present invention.

FIG. 9 is a diagram for describing a switch operation method inside the controller of the hoist according to one embodiment of the present invention. A difference in structure shown in FIGS. 8 And 9 are will be described. In the structure shown in FIG. 9, i.e., the structure according to one embodiment of the present invention, a component for detecting an operation of a switch is not provided on a printed circuit board (PCB). As shown in FIG. 8, when the component for detecting the operation of the switch, i.e., the lift up and down switches 21 and 22, is provided on the PCB, a control current which is generated from a circuit of the PCB due to operations of the lift up and down switches 21 and 22 separately controls a supply or an interruption of control power, which supplies driving energy to the motor, to the motor. That is, in the structure of the controller 10 shown in FIG. 8, when the lift up and down buttons 11 and 12 are pressed, the switches 21 and 22 below the lift up and down buttons 11 and 12 are immediately pressed according to the operations of the lift up and down buttons 11 and 12. Thus, a current is conducting on the PCB, and the control power is applied to the motor only when a function of controlling the current on the PCB to apply the control power to be applied to the motor. Looking at the specific feature of the present invention by comparing FIG. 8 illustrating the structure of a related art with FIG. 9, it can be easily seen, one of features of the present invention comparative to the related art, that contacts of the lift up and down buttons 11 and 12 to which the control power of the motor is applied are provided to be separated from an electric circuit in which the Hall sensor 23 is provided. That is, according to the present invention, an advantageous function and an operation effect may be achieved such that a mechanical contact with a contact communicating with the control power by pressing a button without using a separate control current (in the related art, the separate control current is used) is stably achieved such that an operation of the motor may be initiated, and a degree of an additional descending of the button is adjusted such that a speed of the motor of which operation is initiated may be controlled.

Further, in the structure according to one embodiment of the present invention shown in FIG. 9, the magnet 42 is provided to each of the lift up button 11 and the lift down button 12, and the Hall sensor 23 is also provided below each of the lift up button 11 and the lift down button 12. The above structure is different from the structure in which a common magnet and a common Hall sensor are employed using the pressing transfer parts 31 and 32 shown in FIG. 8.

In the structure according to the embodiment of the present invention, since the lift up button 11 and the lift down button 12 have the same structure, only the lift up button 11 and a corresponding structure will be typically illustrated and a control method of the hoist according to pressing of the lift up button 11 will be described.

A left side of FIG. 9, i.e., a first state, is a steady state. In the steady state, the lift up button 11 is not operated. Contacts 60 are not in contact with each other, and the magnet 42 mounted inside the lift up button 11 does not descend at all. A center of FIG. 9, i.e., a second state, is a state in which the contacts are in contact with each other. Referring to FIG. 9, although the contacts 60 are shown as being two upper contacts and two lower contacts, a contact structure of the controller of the hoist according to the present invention is not limited thereto. The fact that the upper contacts and the lower contacts are in contact with each other means that control power is electrically conducting therebetween and power is provided to the motor, which operates the hoist, such that the motor performs an ascending operation. As described above, the illustration of the contacts 60 of FIG. 9 should not be construed as limiting the structure of the contacts 60 of the present invention. Actually, the contact 60 is formed of a conductor extending in a horizontal direction with respect to the lift up button 11 which vertically ascends and descends similar to that shown in FIG. 9, and the contact 60 is configured with an upper contact of which movement is interlocked with the ascending or descending of the lift up button 11 and a lower contact fixed below the upper contact. However, the contact 60 may employ any structure in addition to the above-described structure. For example, electrically conductible contacts serving as the upper contact and the lower contact may be formed inside the lift up button 11. For example, when the lift up button 11 is provided as a double wall structure, a contact is disposed on the double wall structure, and each of walls may relatively ascend with respect to each other, it may be configured such that contacts are disposed in the lift up button 11 and are in contact with each other and then are released from each other according to a pressed state or a release state of the lift up button 11. In the case of the above internal contact installation structure of the lift-up button 11, even when the lift up button 11 further descends, a vertical gap between the contacts is appropriately adjusted such that varying a relative distance between the magnet 42 and the Hall sensor 23 while maintaining a mutual contact state of the contacts may be achieved through a simple structure. In a right side of FIG. 9, i.e., a third state, the lift up button 11 further descends in a state in which the contacts 60 are in contact with each other and thus a position of the magnet 42 is moved down such that a variation in magnetic flux density (of which unit is a gauss and a description of a "gauss variation" in FIG. 9 directly means a variation in magnetic flux density), which is detected by the Hall sensor 23, occurs. In the third state of FIG. 9, a user may adjust a force pressing the lift up button 11 to control a distance between the magnet 42 and the Hall sensor 23 which are provided inside the lift up button 11 in a state in which the contacts 60 are in contact with each other, i.e., in a state in which the motor of the hoist performs an ascending operation of the hoist. Thus, an operating speed of the motor performing the ascending operation of the hoist may be controllable.

Figure 10:
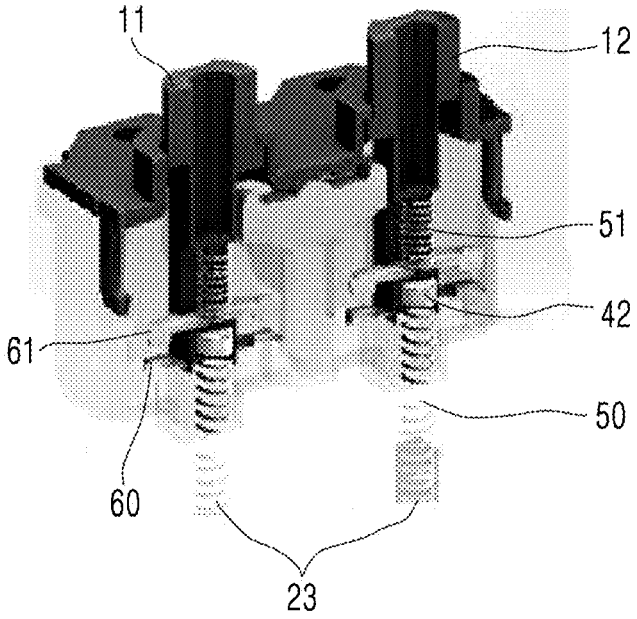
FIG. 10 is a perspective view for describing the switch operation method inside the controller of the hoist according to one embodiment of the present invention.

FIG. 10 is a perspective view illustrating in more detail an internal structure of the controller of the hoist according to one embodiment of the present invention. The illustration of FIG. 9 is a more comprehensive diagram for conceptually describing the operation of the controller of the hoist according to one embodiment of the present invention, whereas the illustration of FIG. 10 is for describing a more specific embodiment. In the embodiment shown in FIG. 10, two contacts 60 are provided at each of the lift up button 11 and the lift down button 12. Both of the lift up button 11 and the lift down button 12 are shown in FIG. 10. For example, it is assumed that a left switch is the lift up button 11 and a right switch is the lift down button 12. Two lift up button contacts 60 are provided at the left switch, i.e., lift up button 11, and two lift down button contacts 60 are provided at the right switch, i.e., the lift down button 12. A conductive contact portion 61 of a horizontally extending shape is provided to each of the lift up button 11 and the lift down button 12 in the same structure. A component designated as the conductive contact portion 61 in connection with the embodiment of FIG. 10 corresponds to a component called the upper contact in the embodiment of FIG. 9. In connection with FIG. 9, since the conductive contact portion 61 which is located at an upper portion and moves according to pressing of the button and the conductive contact portion 61 which is located below the conductive contact portion which is located at the upper portion are comprehensively described regardless of the forms of the conductive contact portions 61, both of the upper contact and the second contact are designated as the single reference numeral "60." However, it is necessary to pay attention to a structural feature such that the contact 60 which is located at a lower portion and fixed is discriminately designated from the conductive contact portion 61 which is located at an upper portion and is moved according to the pressing of the lift up button 11. In the embodiment shown in FIG. 10, the conductive contact portion 61 is connected to the lift up button 11 via a spring 51. When the lift up button 11 is pressed, the conductive contact portion 61 connected to the lift up button 11 through the spring 51 also descends to come into contact with the contact 60 through which the control power is conducting. When the lift up button 11 is further pressed after the above-described contact, the conductive contact portion 61 does not further descend due to being in contact with the contact 60, and the spring 51 is compressed. Owing to pressing the lift up button 11, the permanent magnet 42 connected to a lower end of the lift up button 11 descends regardless of the contact between the contact 60 and the conductive contact portion 61, and the spring 50 is connected to a lower end of the permanent magnet 42. That is, the lift up button 11 may be further pressed in a state in which the conductive contact portion 61 which descends due to the pressing of the lift-up button 11 is in contact with the contact 60, and owing to the further pressing, a relative distance between the permanent magnet 42 and the Hall sensor 23 is varied such that a magnetic flux density applied to the Hall sensor 23 is varied. This varies an output voltage which is output from the Hall sensor 23. When the pressing of the lift-up button 11 is interrupted due to a restoring force of the spring 50, the lift-up button 11 ascends and a magnitude of the output voltage, which is output from the Hall sensor 23, is reduced while the permanent magnet 42 ascends first. The further ascending of the lift up button 11 separates the conductive contact portion 61 from the contact 60, and this separation interrupts the conducting of the control power to the motor such that the operation of the motor is stopped. A variation in output voltage which is output from the Hall sensor 23 varies the operating speed of the motor. There are three typical methods and the typical methods will be briefly described below.

First, a digital pulse method will be described. In the structure of the controller described with reference to FIG. 9 or 10, the magnetic flux density of the Hall sensor 23 may increase as the lift-up button 11 is pressed by the user, the output voltage which is output from the Hall sensor 23 may be in proportion to the increased magnetic flux density, and a frequency of a signal applied to the motor may be varied according to the output voltage such that a speed of the motor may be varied.

For example, according to one embodiment of the present invention, as the lift up button 11 or the lift down button 12 is pressed by the user, the magnetic flux density of the Hall sensor 23 may be increased and the output voltage, which is output from the Hall sensor 23, may be increased in proportion to the increased magnetic flux density. Further, according to one embodiment of the present invention, the frequency of the signal applied to the motor is increased in proportion to the increased output voltage such that the speed of the motor may be controlled to be increased. For example, according to one embodiment of the present invention, a voltage controlled oscillator (VCO) may be used so as to vary the frequency in proportion to the output voltage.

More specifically, a gap between the magnet 42 and the Hall sensor 23 is varied according to a pressed degree of the lift up button 11 or the lift down button 12 of the controller 10 of the hoist. The varied gap applies a different magnetic flux density to an upper end of the Hall sensor 23 which is vertically located with respect to the magnet 42. The gap is inversely proportional to the magnetic flux density, and the Hall sensor 23 outputs a voltage proportional to the magnetic flux density through a Hall element and an amplifier. The output voltage which is output from the Hall sensor 23 is input to the VCO comprised of two operational amplifiers and a transistor. The VCO outputs a digital pulse of which frequency is proportional to the pressed degree of the lift up button 11 or the lift down button 12 of the controller 10, and the digital pulse having a variable frequency is input as an inverter command signal. Here, when the pressed degree of the lift up button 11 or the lift down button 12 of the controller 10 is large, an output frequency value of the digital pulse of the VCO becomes larger, whereas, when the pressed degree of the lift up button 11 or the lift down button 12 of the controller 10 is small, the output frequency value of the digital pulse of the VCO becomes smaller. A variation range of the output frequency value of the VCO is set in an analog range, a multiple-stage speed command signal in a wide range is usable as compared with a digital method, and the motor of the hoist is controlled in a multi-stage according to the pressed degree of the lift up button 11 or the lift down button 12 of the controller 10.

Alternatively, according to one embodiment of the present invention, as the lift up button 11 or the lift down button 12, which is pressed, is released from the user, a position of the lift up button 11 or the lift down button 12 may be restored due to an action of the spring 50 in a direction opposite a pressing direction. In this case, according to one embodiment of the present invention, the magnetic flux density of the Hall sensor 23 may be reduced, and the output voltage which is output from the Hall sensor 23 may be reduced in proportion to the reduced magnetic flux density. Further, according to one embodiment of the present invention, the frequency of the signal applied to the motor is decreased in proportion to the reduced output voltage such that the speed of the motor may be controlled to be decreased. The above-described speed control method of the motor will be more specifically understood with reference to FIG. 11.

Another control method of the speed of the motor includes a pulse width modulation (PWM) method. According to one embodiment of the present invention, as the lift up button 11 is pressed by the user with the method shown in FIG. 9, the output voltage which is output from the Hall sensor 23 may be varied, and a duty ratio of a PWM signal, which is applied to the motor according to the output voltage, is adjusted such that the speed of the motor may be varied.

For example, according to one embodiment of the present invention, as the lift up button 11 or the lift down button 12 is pressed by the user, the magnetic flux density of the Hall sensor 23 may be increased and the output voltage, which is output from the Hall sensor 23, may be increased in proportion to the increased magnetic flux density. Further, according to one embodiment of the present invention, the duty ratio of the PWM signal applied to the motor is increased in proportion to the increased output voltage such that the speed of the motor may be controlled to be increased. More specifically, the output voltage which is output from the Hall sensor 23 may be input to an analog-to-digital converter (ADC) and converted into a digital value. The converted digital value is converted into a PWM duty which is proportional to the pressed degree of the lift up button 11 or the lift down button 12 of the controller 10 of the hoist using software and a PWM clock generation circuit of a microprocessor (MCU). That is, when the pressed degree of the lift up button 11 or the lift down button 12 of the controller 10 of the hoist is large, the PWM duty becomes larger, whereas, when the pressed degree of the lift up button 11 or the lift down button 12 of the controller 10 of the hoist is small, the PWM duty becomes smaller. Since a variation range of the PWM duty may have 10 bits, i.e., 1024 different values, the PWM pulse is used as 1024 multi-stage speed command signals of a variable speed inverter of the hoist, and the motor of the hoist is controlled in a multi-stage according to the pressed degree of the lift up button 11 or the lift down button 12 of the controller 10 of the hoist.

Figure 12:
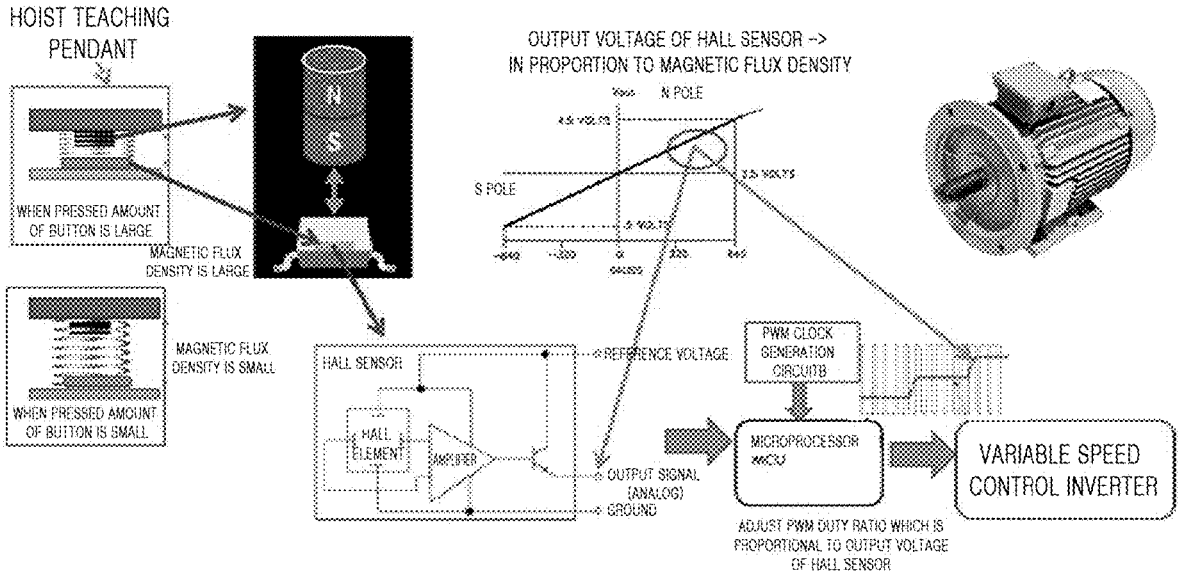
FIG. 12 is a diagram for describing a method of varying a speed of a motor according to a manipulation of the controller according to one embodiment of the present invention.

Alternatively, according to one embodiment of the present invention, as the lift up button 11 or the lift down button 12, which is pressed, is released from the user, a position of the lift up button 11 or the lift down button 12 may be restored due to the spring 50 in a direction opposite a pressing direction. In this case, according to one embodiment of the present invention, the magnetic flux density of the Hall sensor 23 may be reduced, and the output voltage which is output from the Hall sensor 23 may be reduced in proportion to the reduced magnetic flux density. Further, according to one embodiment of the present invention, the duty ratio of the PWM signal applied to the motor is decreased in proportion to the reduced output voltage such that the speed of the motor may be controlled to be decreased. The above-described speed control method of the motor will be more specifically understood with reference to FIG. 12.

Still another control method of a speed of the motor includes a variable resistance method. As in the method shown in FIG. 9, the magnetic flux density of the Hall sensor 23 may increase as the lift-up button 11 is pressed by the user, the output voltage which is output from the Hall sensor 23 may be in proportion to the increased magnetic flux density, and a frequency of a signal applied to the motor may be varied according to the output voltage such that a speed of the motor may be varied.

For example, according to one embodiment of the present invention, as the lift up button 11 or the lift down button 12 is pressed by the user, a magnetic flux density of the Hall sensor 23 may be increased and the output voltage, which is output from the Hall sensor 23, may be increased in proportion to the increased magnetic flux density. Further, according to one embodiment of the present invention, the load (i.e., variable resistance) applied to the motor is increased in proportion to the increased output voltage such that the speed of the motor may be controlled to be increased.

More specifically, a gap between the magnet 42 and the Hall sensor 23 is varied according to the pressed degree of the lift up button 11 or the lift down button 12 of the controller 10 of the hoist. The varied gap applies a different magnetic flux density to an upper end of the Hall sensor 23 which is vertically located with respect to the magnet 42. The gap is inversely proportional to the magnetic flux density, and the Hall sensor 23 outputs a voltage proportional to the magnetic flux density through a Hall element and the amplifier. The output voltage of the Hall sensor 23 is input to the ADC and then converted into a digital value. The converted digital value is converted into a variable resistance value which is proportional to the pressed degree of the button of the controller 10 using digital potentiometer control software and a digital potentiometer control circuit of a microprocessor (MCU). That is, when the pressed degree of the button is large, a variable resistance value of a digital potentiometer becomes large, whereas, when the pressed degree of the button is small, the variable resistance value becomes small. Since a range of the variable resistance value of the digital potentiometer may have 8 bits, i.e., 256 different values, a PWM pulse is used as 256 multi-stage speed command signals of a variable speed inverter of the hoist, and the motor of the hoist is controlled in a multi-stage according to the pressed degree of the button of the controller 10.

Figure 13:
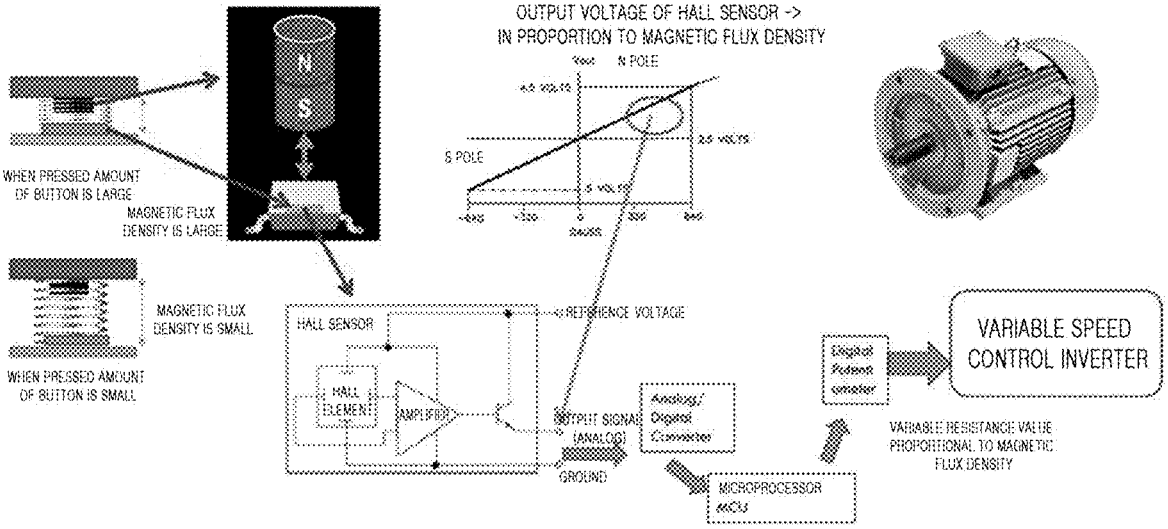
FIG. 13 is a diagram for describing a method of varying a speed of a motor according to a manipulation of the controller according to one embodiment of the present invention.

Alternatively, according to one embodiment of the present invention, as the lift up button 11 or the lift down button 12, which is pressed, is released from the user, a position of the lift up button 11 or the lift down button 12 may be restored due to an action of the spring 50 in a direction opposite a pressing direction. In this case, according to one embodiment of the present invention, the magnetic flux density of the Hall sensor 23 may be reduced, and the output voltage which is output from the Hall sensor 23 may be reduced in proportion to the reduced magnetic flux density. Further, according to one embodiment of the present invention, the load applied to the motor is decreased in proportion to the reduced output voltage such that the speed of the motor may be controlled to be decreased. The above-described speed control method of the motor will be more specifically understood with reference to FIG. 13.

In accordance with the present invention, a controller of an electric hoist using an inverter driven motor, which is capable of performing multi-stage speed control of lifting up and down operations of the electric hoist, can be provided.

Further, in accordance with the present invention, a hoist including the controller can be provided.

While the present invention has been described with reference to specific items such as particular components, exemplary embodiments, and drawings, these are merely provided to help understanding the present invention, and the present invention is not limited to these embodiments, and those skilled in the art to which the present invention pertains can variously alter and modify from the description of the present invention.

Therefore, the spirit of the present invention should not be limited to the above-described embodiments, and it should be construed that the appended claims as well as all equivalents or equivalent modifications of the appended claims will fall within the scope of the present invention.

What is claimed is:

1. A controller of a hoist, comprising:

a lift up button which is adjustable in a pressed degree;

a lift down button which is adjustable in a pressed degree;

lift up button contacts configured to be in contact with the lift up button when the lift up button is pressed and allow ascending direction control power to flow to a motor;

lift down button contacts configured to be in contact with the lift down button when the lift down button is pressed and allow descending direction control power to flow to the motor;

a magnet accommodated in each of the lift up button and the lift down button; and a Hall sensor disposed to detect a descending degree of the magnet accommodated in each of the lift up button and the lift down button, and wherein, when the lift up button is pressed, the lift up button contacts are primarily brought into contact such that the ascending direction control power is applied to the motor, the lift up button is further pressed in such a state, a pressed degree of the lift up button is adjustable, a relative distance between the magnet accommodated in the lift up button and a corresponding Hall sensor is variable, and a speed of an ascending operation of the motor is varied according to an output voltage which is varied according to an increase or decrease of a magnetic flux density detected by the Hall sensor, when the lift down button is pressed, the lift down button contacts are primarily brought into contact such that the descending direction control power is applied to the motor, the lift down button is further pressed in such a state, a pressed degree of the lift down button is adjustable, a relative distance between the magnet accommodated in the lift down button and a corresponding Hall sensor is variable, and a speed of a descending operation of the motor is varied according to an output voltage which is varied according to the increase or decrease of the magnetic flux density detected by the Hall sensor, two lift up button contacts and two lift down button contacts are provided, and when a conductive contact portion of a horizontal extending shape connected to the lift up button and the lift down button is brought into contact with the two lift up button contacts or the two lift down button contacts, control power is conducting such that an operation of the motor is initiated, and the two lift up button contacts and the two lift down button contacts, to which the control power of the motor is applied, are provided to be separated from an electric circuit in which the Hall sensor is provided.

2. A hoist comprising the controller according to claim 1.

* * * * *